US008968833B2

(12) United States Patent
Gabrisch et al.

(10) Patent No.: US 8,968,833 B2
(45) Date of Patent: Mar. 3, 2015

(54) ANTIBALLISTIC ARTICLE WITH RESIN

(75) Inventors: Hans-Joachim Gabrisch, Hurtgenwald (DE); Margarete-Anna Gabrisch, Hurtgenwald (DE)

(73) Assignee: Teijin Aramid GmbH, Wuppertal (DE)

( * ) Notice: Subject to any disclaimer, the term of this patent is extended or adjusted under 35 U.S.C. 154(b) by 0 days.

(21) Appl. No.: 14/240,572

(22) PCT Filed: Sep. 5, 2012

(86) PCT No.: PCT/EP2012/067308

§ 371 (c)(1), (2), (4) Date: Feb. 24, 2014

(87) PCT Pub. No.: WO2013/034589

PCT Pub. Date: Mar. 14, 2013

(65) Prior Publication Data

US 2014/0212590 A1 Jul. 31, 2014

(30) Foreign Application Priority Data

Sep. 7, 2011 (EP) ..... 11180397

(51) Int. Cl.

| | |
|---|---|
| ***B32B 27/34*** | (2006.01) |
| ***F41H 1/08*** | (2006.01) |
| ***F41H 5/04*** | (2006.01) |

(52) U.S. Cl.

CPC ..... *F41H 1/08* (2013.01); *F41H 5/0471* (2013.01)

USPC ..... 427/372.2; 428/102; 428/405; 442/134; 442/135

(58) Field of Classification Search

CPC ..... F41H 1/08; F41H 5/0471; F41H 5/04; B32B 5/26; B32B 27/34

USPC ..... 427/372.2, 379, 381; 428/98, 102, 105, 428/114, 119, 141, 147, 911; 447/134, 135, 447/185, 187, 188, 239, 242; 442/134, 135, 442/185, 187, 188, 239, 242; 2/2.5; 89/36.03

See application file for complete search history.

(56) References Cited

FOREIGN PATENT DOCUMENTS

| | | | |
|---|---|---|---|
| DE | 198 16 722 | A1 | 10/1999 |
| EP | 0 641 988 | A1 | 8/1995 |
| EP | 1 908 586 | A1 | 4/2008 |
| GB | 222745 | | 10/1924 |
| GB | 2 227 450 | A | 8/1990 |
| WO | WO 2006/107197 | | 10/2006 |
| WO | WO 2011/076914 | A1 | 6/2011 |

OTHER PUBLICATIONS

International Search Report for PCT/EP2012/067308, issued Nov. 27, 2012.

*Primary Examiner* — Arti Singh-Pandey
(74) *Attorney, Agent, or Firm* — Oliff PLC

(57) ABSTRACT

An antiballistic article and method of making the antiballistic article. The antiballistic article is made by applying a resin on the surface of at least one fabric layer such that the resin forms a network with a degree of cross-linking of at least 80% within no more than 350 seconds at a temperature of 130° C. at most.

11 Claims, No Drawings

ANTIBALLISTIC ARTICLE WITH RESIN

The invention pertains to a method for producing an antiballistic article, whereby a resin is applied on a surface of at least one fabric layer. The invention pertains also to an antiballistic article made by the method according to this invention.

Methods for producing antiballistic articles with a resin are known in the prior art.

In document EP 0641988 a method for producing a composite material from high-modulus fiber material is described. In the production process a binder is used, whereby the binder has a resol content in the range of from 4 to 20% by weight and a polyvinyl butyral content in the range of from 75 to 95% by weight. During the manufacturing process temperature in the range of 140 to 180° C. are used and the cross-linking time is about 16 minutes for the used resin system described in this document.

Further, GB 222 745 describes a method for manufacturing a fabric reinforced composite article with ballistic resistance. The composite is made by dipping pre-heated polyamide fabrics into resin, drying the fabrics, stacking them and heating and pressurizing the stack. The polyamide fabrics comprise aromatic polyamide filament yarn fabrics and aliphatic polyamide filament yarn fabrics. The aliphatic polyamide fabrics are placed as outer layers. The resins can e.g. be a phenolic resol with polyvinyl butyral.

When used in the present invention, the term "resin" should be understood as "synthetic resin" in accordance with ISO 4618/3 and should be defined as resins resulting from controlled chemical reactions such as polyaddition or polycondensation between well-defined reactants that do not have the characteristics of resins. Synthetic resins are also obtained by polymerization of unsaturated monomers. Synthetic resins are obtained mainly by addition polymerization and polycondensation, which are intermediates in the synthesis of higher molecular mass plastics.

More particularly, phenolic resins are polycondensation products of phenols and aldehydes, in particular phenol and formaldehyde. Phenolic resins are classified as novolacs and resols. In resols the polycondensation is base-catalyzed and has been stopped deliberately before completion. Characteristic functional groups of this class of resins are the hydroxymethyl group and the dimethylene ether bridge. Both are reactive groups. During processing the polycondensation can be restarted by heating and/or addition of catalysts, i.e. resols are self-crosslinking. In the case of novolacs the polycondensation is brought to completion. The molecular growth of these thermoplastic synthetic resins is limited by addition of a substoichiometric amount of the aldehyde component. However, novolacs can be cross-linked by addition of curing agents, such as formaldehyde or hexamethylenetetramine, and give end products similar to resols.

Resols are known in the art. They are base-catalyzed phenol-formaldehyde resins with formaldehyde to phenol ration of greater than 1 (usually around 1.5). They are synthesized from phenol, formaldehyde, water and a catalyst.

The method according the prior art has the disadvantages that the cross-linking time is relatively long and extreme high temperatures must be used. Both conditions increase the production costs and make the producing process complex. In addition, due to the long cross-linking time the resin can flow away during the manufacturing process and mold tools and surrounding area is polluted by resin.

Therefore, the aim of this invention is to provide a method in which the production time can be reduced, whereby at the same time the process costs decrease.

The aim is achieved by a method for producing an antiballistic article, comprising the step of application of a resin on a surface of at least one fabric layer, whereby the resin forms a network with a degree of cross-linking of at least 80% within no more than 350 seconds at a temperature of at most 130° C. Due to the use of a "fast" curable resin the temperature during the producing process can be lower than the normal used temperature in conventional manufacturing process and no long preheating time in the manufacturing process is necessary. Furthermore, the energy costs decrease due to the lower temperature and the clock rate increases due to the shorter curing time of the resin. In particular and in contrast to the prior art requirement, no preheating is step is necessary. All these facts reduce the costs of the article and protect the environment. A further advantageous fact is that the pollution during the manufacturing process decreases due to the use of a fast curing resin—nearly no resin flows away during the process.

Preferably, the resin forms a network with a degree of cross-linking of at least 90% within no more than 300 seconds at a temperature of at most 130° C.

It is further preferred that the resin forms a network with a degree of cross-linking of at least 98% within no more than 250 seconds at a temperature of at most 130° C.

Preferably, the resin contains phenolic resol. In a preferred embodiment the phenolic resol content in the resin is approximately 30% by weight. Preferably, the phenolic resol content in the resin is in the range of 20 to 50% by weight and most preferred in the range of 25 to 35% by weight.

In a preferred embodiment the resin contains polyvinylbutyral.

A person skilled in the art is familiar with the production of the polyvinylbutyral by acid-catalyzed acetalation of polyvinyl alcohol with preferentially aliphatic aldehydes, especially n-butyraldehyde and/or acetaldehyde. The polyvinyl butyrals and/or their production process disclosed in DE 19 816 722 A1 are particularly suitable. The term "polyvinylbutyral" refers to any product of acetalation of polyvinyl alcohol with one or more aliphatic aldehydes.

Therefore, in a preferred embodiment the resin is a combination of polyvinylbutyral and phenolic resol, whereby the resin contains also additives like release agents. In a preferred embodiment the polyvinylbutyral content in the resin is approximately 65% by weight. Preferably, the polyvinylbutyral content in the resin is in the range of 50 to 80% by weight and most preferred in the range of 70 to 75% by weight.

By applying the mentioned compositions one can avoid the preheating step necessary with the prior art compositions.

Preferably, the at least one fabric layer is a woven fabric layer. The woven fabric layer has preferably a plain, satin and/or twill weave. If more than one woven fabric layer is used the woven fabric layers have the same or different weaving pattern. It is also possible, that one woven fabric layer has more than one weaving pattern, whereby this woven fabric layer can be used in combination with woven fabric layers with more than one weaving pattern or with one or more woven fabric layers with one weaving pattern. Preferably, at least one woven fabric layer is made from a 1680 aramid yarn, having 1000 filaments. The woven fabric has preferably a warp/weft rapport of 2000 and is basket weave (2×2). The warp and weft threads/cm is 127 and the areal density is 410 g/m$^2$. Such a fabric is sold by Teijin Aramid GmbH under the name CT 736.

In a preferred embodiment the at least one fabric layer is a unidirectional fiber layer. For purposes herein, the term "fiber" is defined as a relatively flexible, macroscopically homogeneous body having a high ratio of length to width across its cross-sectional area perpendicular to its length. The term "fiber" includes also a tape form. The fiber cross section can be any shape, but is typically circular. Herein, the term "filament" is used interchangeably with the term "fiber". The fibers can be any length. The fibers can be continuous filaments, which are filaments that extend typically for a meter or much longer. Filaments are spun in a continuous form frequently as part of a multifilament yarn, wound unto a spool and then cut after the desired amount is placed on the spool. The filaments can be cut into staple fibers having a length of about 0.64 cm to about 12.7 cm. The staple fiber can be straight (i.e., non crimped) or crimped to have a saw tooth shaped crimp along its length, with a crimp (or repeating bend) frequency of about 1.4 to about 7.1 crimps per cm. The term "yarn" is a generic term for a continuous strand of textile fibers, filaments, or material in a form suitable for knitting, weaving, or otherwise intertwining to form a fabric layer.

In a unidirectional fiber layer all fibers in the layer are arranged in the same direction, whereby the fibers are preferably arranged approximately parallel to each other. The unidirectional fiber layer may have binder threats and/or a binding resin, which connect the unidirectional fibers in one layer. It is also possible that the unidirectional fiber layers may have binder threats, which connect more than one unidirectional fiber layers with each other. If more than one unidirectional fiber layer is used the fibers in each layer can be arranged in an angle to a successor unidirectional fiber layer. This means a first unidirectional fiber layer is arranged in a 0° orientation, the successor unidirectional fiber layer is arranged in a ±45° or 90° orientation. It is also possible that the fibers in successor layers oriented parallel to each other, but with offset to each other.

In one preferred embodiment a plurality of fabric layers are used for the antiballistic article produced by the disclosed method, whereby only woven fabric layers, only unidirectional fiber layers or a combination of unidirectional fiber layers and woven fabric layers can be used. Preferably, a combination of a plurality of aramid woven fabric layers and a plurality of unidirectional fiber layers are used, whereby the unidirectional fiber layers are made of tapes, whereby the tapes are made of ultra high molecular weight polyethylene. The construction of the unidirectional fiber layers made of such tapes is described in international application PCT/NL2006/000179 and in EP 1 908 586, which contents are insert via reference.

Preferably, the at least one fabric layer comprises aromatic polyamide fibers and/or polyethylene fibers. Especially preferred the at least one fabric layer comprises para(phenylene-terephthalamid) fibers and/or ultra high polyethylene tapes. It is also preferred, that the at least one fabric layer comprises a copolymer of aromatic polyamide.

Preferably, the resin is applied between two successive fabric layers in the antiballistic article. Preferably, the resin is applied on the main extension area of the fabric layer. In a preferred embodiment the antiballistic article is built up by a first fabric layer, a resin coating on the first fabric layer and a second fabric layer on top of the resin coating of the first fabric layer, whereby further fabric layers with coating can follow.

Preferably, a helmet as antiballistic article is produced in a single process step in which at least three parts of a single shell are combined with each other to the one single shell. Preferably, a plurality of fabric layers built up a first part, a plurality of fabric layers built up a second part and a third kind of fabric layers built up a third part of the single shell. All fabric layers (for the first, second and third part) are molded in one process step to one helmet. This means no single shells are produced (which must then be combined to one helmet in a further process step). The fabric layers for the first and third part are preferably woven aramid layers and the second part is preferably made of unidirectional layers made of ultra-high polyethylene tapes. The second part is preferably sandwiched between the first and the second part.

The invention pertains also to an antiballistic article produced by the method according to the explanation above.

Preferably, the antiballistic article is a helmet or a plate. The plate can be used in the soft-ballistic or in the hard-ballistic.

If the antiballistic article is a helmet, the helmet preferably comprises a part made of aramid and/or polyethylene. The aramid part and/or the polyethylene part is made of the fabric layers, whereby at least one, preferably a plurality of fabric layers forms the part. The aramid part contains preferably fabric layers made of para(phenylene-terephthalamid) fibers and the polyethylene part contains preferably tape layers made of ultra-high molecular polyethylene. In a preferred embodiment the helmet comprises (starting from the head of a user) a first part made of aramid woven fabric layers, a second part made of ultra-high molecular polyethylene tapes and a third part made of aramid woven layers, whereby all tree part are connected with each other to one single shell. This means, the polyethylene part is sandwiched between two aramid parts.

In a preferred embodiment the resin described above is arranged between the aramid part and the polyethylene part. In a further preferred embodiment the resin described above is applied between the fabric layers, which forms the aramid part and between the aramid parts themselves. In a preferred embodiment the polyethylene part is free of the described resin and only the aramid parts comprise the resin.

The invention is further elucidated by one example, which is given below.

Test Method for Finding Suitable Phenolic Resol Resin:

The degree of cross-linking is measured by IPC-TM-650, which is used by the institute for interconnecting and packaging electronic circuits (2215 Sanders Road, Northbrook, Ill. 60062-6135).

The purpose of this test method is to provide a procedure for determining the gel time of resin pre-impregnated "B" Stage glass fabric Sufficient quantity of prepreg is used to yield approximately 1000 milligrams of dry resin powder.

The Following Equipment is Needed:

- Platen, hot plate or melting point apparatus capable of maintaining a temperature of 130° C. (255° F.)±0.5° C.
- Timer, capable of determining time within ±1 second.
- Toothpicks.
- Plastic/polyethylene bags or suitable container.
- Analytical balance capable of weighting within ±20 milligrams.
- Wire Mesh-60 mesh.
- Montan Wax.

The Procedure can be Described as Follows:

Place the prepreg (B-Stage) in a plastic bag or other suitable container, and extract the dry resin from the B-Stage by folding or crushing.

Allow the B-Stage resin to collect in the bottom of the plastic bag.

Pour the collected resin into a container trough 60 wire mesh, to remove any fiber glass particles.

Set the melting point apparatus at test temperature (e.g. 130° C.±0.5° C.) and allow stabilizing at that temperature.

Using the analytical balance weigh out 200±20 milligrams of resin on to 3 inch×3 inch (7.62×7.62 cm) sheet of wax paper or suitable container.

Make sure that the melting point apparatus is clean; mold released with montan wax or equivalent; and wiped free of any visible mold release.

Pour 200 milligrams sample of resin on the center of the melting point apparatus and start the timing device immediately.

Place the tapered end of a round toothpick against the surface of the cure plate (end of the toothpick not in contact with surface of the cure plate will have to be elevated slightly).

Roll toothpick back and forth, maintaining contact with the surface of the cure plate until 20 seconds have elapsed.

At this time start stroking the resin immediately, using a circular motion ⅜ to ½ inch (0.95 to 1.27 cm) in diameter. Stroke in such a manner that every circle moves part of the resin from the center of the pool to the outside, and part of the resin from the outside of the pool toward the center. Care should be taken to limit the pool size to an area ¾ to ⅞ inch (1.91 to 2.22 cm) in diameter.

Keep the toothpick in contact with resin and surface of the cure plate at all times. As the resin becomes stiff, it will not be possible to continue exchanging outside resin with the inside resin, but continue stroking with as much exchange as possible without breaking the toothpick.

If the resin breaks up, continue stroking the largest piece. If this piece breaks up, continue stroking the largest remaining piece of this portion even though now a larger piece of the original pool may be present at some other place on the hot plate.

When the stroked piece separates from the hot plate, stop the watch. This is the end point, and the total elapsed time in the gel time.

Example 1

Example 1 relates to a helmet made by the method described above.

The helmet comprises three parts, whereby a first and a third part is made of aramid woven fabric layers. The second part is sandwiched between the aramid parts and is made of ultra-high molecular polyethylene tapes. The helmet is produced in one single molding step, in which the aramid parts and the polyethylene part are connected to one single shell.

Aramid Parts:

Woven Layers:

Both aramid parts comprise four woven fabric layers. Each woven fabric layer is made of aramid yarns having a linear density of 1680 and 1000 filaments. The warp and weft ratio in the woven fabric is 2000 and the fabric is basket woven (2×2). The warp and weft threads per 10 cm is 127, the woven fabric has an areal density of 410 g/m$^2$, a thickness of 0.62 mm and is sold by Teijin Aramid GmbH under the name CT736. On each woven fabric layer a film layer made of a phenolic resol resin is applied.

Film Layer Made of Phenolic Resol Resin:

A suitable phenolic resol resin is selected, whereby the resin must be a fast curing resin. Fast curing resins are resins, which show the following behavior: the resin forms a network with a degree of cross-linking of at least 80% within no more than 350 seconds at a temperature of at most 130° C. The resin has a phenolic resol content of 30% by weight and a PVB content of 65% by weight, further containing 5% by weight of additives, such as accelerators. For selecting a suitable resin the test method IPC-TM-650 (see above) is used. The resin is applied to a carrier foil (a PET-foil) via a doctor blade and the film is heated for vaporization of solvent.

A very suitable PVB containing phenolic resol can be prepared starting from the commercially available product "DURAPREG-Film 4228" from the company "Von Roll Deutschland GmbH", D-52353 Düren and replacing the phenolic resol component by the one available under the designation PA 3023X from the company "Chemiplastica SPA", Carbonate, Italy. By this replacement the resin fulfills the criterion of fast curing as set forth in this invention.

The film layer is applied to each aramid woven layer in a calendaring step, whereby the calendaring temperature is 180° C. and the speed is 5 meter per minute. Normal calendaring apparatus is suitable for this step.

Each woven layer comprises a film layer on one surface of the woven fabric layer. Merely one outer woven fabric layer has a film layer on both outer sides of the woven fabric layer. One aramid part has therefore the following construction: first section: phenolic resol film layer, woven fabric layer, phenolic resol film layer, second section: woven fabric layer, phenolic resol film layer, third section: woven fabric layer, phenolic resol film layer, fourth section: woven fabric layer, phenolic resol film layer. The woven fabric layer comprising two phenolic resol film layers, is arranged on the outer side of the helmet, this means in direction to the head of the user or in direction of the surrounding area.

Polyethylene Part

The polyethylene part is made of 40 layers of ultra-high molecular weight polyethylene tapes. The 40 layers of ultra-high molecular weight polyethylene are built up 20 laminates as described in EP 1 908 586. The polyethylene part is phenolic resol resin free. The last polyethylene laminate has an adhesion layer on both outer sides, the adhesion layer is based on the same resin as described in document EP 1 908 586. The adhesion layer prevents the laminate for undesired bonding with the aramid part.

Helmet

The layers (4 woven aramid layers with phenolic resol film layers) for a first aramid part are arranged in a molding device. On top of these layers, 20 laminate layers of polyethylene are arranged (polyethylene part). On top of these 20 laminates, the layers for the second aramid part are arranged. Therefore, the following construction for the helmet is built up in the molding device:

| | |
|---|---|
| (surrounding area) | |
| Phenolic resol film layer | aramid part |
| Aramid woven fabric layer | aramid part |
| Phenolic resol film layer | aramid part |
| Aramid woven fabric layer | aramid part |
| Phenolic resol film layer | aramid part |
| Aramid woven fabric layer | aramid part |
| Phenolic resol film layer | aramid part |
| Aramid woven fabric layer | aramid part |
| Phenolic resol film layer | aramid part |

-continued

| | |
|---|---|
| Polyethylene laminate (comprising two layers of polyethylene tapes) | polyethylene part |
| Polyethylene laminate | |
| Polyethylene laminate | |
| Polyethylene laminate | |
| Polyethylene laminate | |
| Polyethylene laminate | |
| Polyethylene laminate | |
| Polyethylene laminate | |
| Polyethylene laminate | |
| Polyethylene laminate | |
| Phenolic resol film layer | aramid part |
| Aramid woven fabric layer | |
| Phenolic resol film layer | |
| Aramid woven fabric layer | |
| Phenolic resol film layer | |
| Aramid woven fabric layer | |
| Phenolic resol film layer | |
| Aramid woven fabric layer | |
| Phenolic resol film layer | |
| (Head of a user) | |

All layers (for each part) are molded in one step to achieve the helmet.

The molding device is a common molding device for the helmet manufacturing. The helmet is produced by molding all layers at a molding temperature of 130° C., 50 bar pressure for at most 20 minutes, whereas the resin forms a network with a degree of cross-linking of at least 80% after 350 seconds. After the molding process the molding device is cooled by water, oil or air for 5 to 10 minutes.

The invention claimed is:

1. A method for producing an antiballistic article, comprising:

applying a resin on a surface of at least one fabric layer, heating the resin on the surface of the at least one fabric layer at a temperature of at most 130° C., and forming a resin network with a degree of cross-linking of at least 80% within no more than 350 seconds at the temperature of at most 130° C.;

wherein the resin comprises:

a phenolic resol content of approximately 30% by weight, and a polyvinylbutyral content of approximately 65% by weight.

2. The method according claim 1, further comprising forming a resin network with a degree of cross-linking of at least 90% within no more than 300 seconds at the temperature of at most 130° C.

3. The method according to claim 1, further comprising forming a resin network with a degree of cross-linking of at least 98% within no more than 250 seconds at the temperature of at most 130° C.

4. The method according to claim 1, wherein the at least one fabric layer is a woven fabric layer.

5. The method according to claim 1, wherein the at least one fabric layer is a unidirectional fiber layer.

6. The method according to claim 1, wherein the at least one fabric layer comprises para(phenylene-terephthalamide) fibers and/or polyethylene fibers.

7. The method according to claim 1, further comprising applying the resin between two successive fabric layers in the antiballistic article.

8. The method according to claim 1, wherein:

the antiballistic article is a helmet, the helmet is produced in a single process step in which at least three different parts are combined with each other to form one single shell, at least one part comprises polyethylene, and at least one part comprises para-aramid.

9. An antiballistic article produced by the method according to claim 1, wherein the article is a helmet or a plate.

10. The antiballistic article according to claim 9, wherein the article is a helmet and comprises at least one part made of aramid and/or at least one part made of polyethylene.

11. The antiballistic article according to claim 10, wherein the resin is between the part made of aramid and the part made of polyethylene.

* * * * *